US010577902B2

(12) United States Patent
Townsend

(10) Patent No.: US 10,577,902 B2
(45) Date of Patent: Mar. 3, 2020

(54) DOWNHOLE PLUNGER WITH SPRING-BIASED PADS

(71) Applicant: FOURTH DIMENSION DESIGNS LTD., Edmonton (CA)

(72) Inventor: Murray R Townsend, Edmonton (CA)

(73) Assignee: FOURTH DIMENSION DESIGNS LTD., Edmonton, AB (CA)

( * ) Notice: Subject to any disclaimer, the term of this patent is extended or adjusted under 35 U.S.C. 154(b) by 3 days.

(21) Appl. No.: 15/292,576

(22) Filed: Oct. 13, 2016

(65) Prior Publication Data

US 2017/0107801 A1 Apr. 20, 2017

(30) Foreign Application Priority Data

Oct. 14, 2015 (CA) ..... 2908290

(51) Int. Cl.
*E21B 43/12* (2006.01)
*E21B 17/10* (2006.01)

(52) U.S. Cl.
CPC ..... *E21B 43/121* (2013.01); *E21B 17/1014* (2013.01)

(58) Field of Classification Search
CPC ..... E21B 43/121; E21B 17/1014; F04B 47/12
See application file for complete search history.

(56) References Cited

U.S. PATENT DOCUMENTS 2,232,199 A * 2/1941 Bald ..... E21B 33/127 138/90
3,424,066 A * 1/1969 Moore, Jr. ..... E21B 43/121 166/170
3,424,093 A * 1/1969 Moore, Jr. ..... E21B 43/121 417/56
4,531,891 A * 7/1985 Coles, III ..... E21B 43/121 417/59
5,427,504 A 6/1995 Dinning et al.
6,045,335 A * 4/2000 Dinning ..... E21B 43/121 166/372
6,148,923 A * 11/2000 Casey ..... E21B 43/121 166/329
6,644,399 B2 11/2003 Abbott et al.
(Continued)

OTHER PUBLICATIONS

Technical Data for sealing systems by Systems Seals Inc. <http://www.systemseals.com/technical.htm> (retrieved Sep. 27, 2007).

*Primary Examiner* — Nicole Coy
(74) *Attorney, Agent, or Firm* — Davis & Bujold PLLC; Michael J. Bujold

(57) ABSTRACT

A plunger for a gas producing well having a production tubing string has a plunger body with a pad receiving profile defined by first and second pad retainers. A plurality of pads is engaged between the first and second pad retainers, which permit limited radial movement of the pads sufficient to contact an inner surface of the production tubing string. A sheet of resilient material, acting as a spring member, is positioned within the pad receiving profile and between the plurality of pads and the plunger body. The spring member defines an annular chamber between the spring member and the plunger body in fluid communication with the downhole end of the plunger body and provides an outward force to the pads. In use, the openings and pressure chamber allow for a pressure differential across the pads.

3 Claims, 5 Drawing Sheets

(56) References Cited

U.S. PATENT DOCUMENTS

| | | | | |
|---|---|---|---|---|
| 6,669,449 | B2 * | 12/2003 | Giacomino | F04B 47/12 166/153 |
| 6,725,916 | B2 | 4/2004 | Gray et al. | |
| 7,093,652 | B2 * | 8/2006 | Gray | E21B 43/121 166/101 |
| 7,401,544 | B2 | 7/2008 | Townsend | |
| 7,448,442 | B2 | 11/2008 | Wells | |
| 8,347,954 | B2 | 1/2013 | Amies et al. | |
| 8,869,902 | B2 | 10/2014 | Smith et al. | |
| 9,121,269 | B2 * | 9/2015 | Longfellow | E21B 43/121 |
| 9,932,805 | B2 * | 4/2018 | Kuykendall | E21B 43/121 |
| 2005/0025644 | A1 | 2/2005 | Ford | |
| 2006/0144597 | A1 * | 7/2006 | Casey | E21B 43/122 166/372 |
| 2007/0067978 | A1 | 3/2007 | Relan | |
| 2011/0079960 | A1 | 4/2011 | Borden et al. | |
| 2014/0326451 | A1 | 11/2014 | Longfellow et al. | |
| 2015/0053427 | A1 * | 2/2015 | Suttipisetchart | E21B 43/121 166/382 |
| 2016/0237795 | A1 * | 8/2016 | Xiqing | E21B 43/121 |
| 2017/0002634 | A1 * | 1/2017 | Casey | E21B 43/121 |
| 2017/0101856 | A1 * | 4/2017 | Green | E21B 43/122 |

* cited by examiner

DOWNHOLE PLUNGER WITH SPRING-BIASED PADS

TECHNICAL FIELD

This relates to a plunger for use in a gas-producing well that has pads that are biased by a spring outward toward an inner surface of a production tubing string.

BACKGROUND

In hydrocarbon producing wells, it is generally necessary to assist the fluids to reach the surface. In some wells, primarily gas producing wells (i.e. wells in formations that produce a high concentration of gas-phase hydrocarbons), one system used to assist production involves the use of a plunger, which acts as a piston to lift accumulated liquids. The plunger is moved upward by gas pressure below the plunger, and then returns downhole once pressure is reduced.

In order to allow the plunger to fall after being lifted to surface, the engagement between the plunger and the inner surface of the production tubing cannot be too strong. At the same time, the engagement must be able to create a sufficient pressure differential across the plunger in order to provide the necessary lift to the plunger. U.S. Pat. No. 8,869,902 (Smith et al.) and U.S. Pat. No. 7,448,442 (Wells) each describe plungers with wear pads carried by a plunger. Downhole pressure enters behind the wear pads to bias them outwards to improve the sealing of the plunger assembly.

SUMMARY

In one aspect, there is provided a plunger for a gas producing well having a production tubing string. The plunger comprises a plunger body having a pad receiving profile defined by a first pad retainer positioned toward a downhole end of the plunger body and a second pad retainer positioned toward a surface end of the plunger body. A plurality of pads are engaged between the first pad retainer and the second pad retainer, the first and second pad retainers permitting limited radial movement of the pads sufficient to contact an inner surface of the production tubing string. A spring member is positioned within the pad receiving profile and between the plurality of pads and the plunger body. The spring member comprises a sheet of resilient material that is wrapped around the plunger body in an overlapping manner, the sheet of resilient material applying an outward force to the plurality of pads and defining an annular chamber between the spring member and the plunger body. There are one or more flow channels in fluid communication with the annular chamber and the downhole end of the plunger body such that in use, downhole pressure is communicated to the annular chamber to create a pressure differential between the annular chamber and an outer surface of the plurality of pads. The downhole pressure in the annular chamber preferably creates a pressure differential across the plurality of pads.

In another aspect, the sheet of resilient material may comprise alignment tabs along a bottom edge, the alignment tabs engaging openings toward the downhole end of the plunger body, the openings being provided in at least one of the plurality of pads and the first pad retainer. The openings engaged by the alignment tabs may comprise the one or more flow channels.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
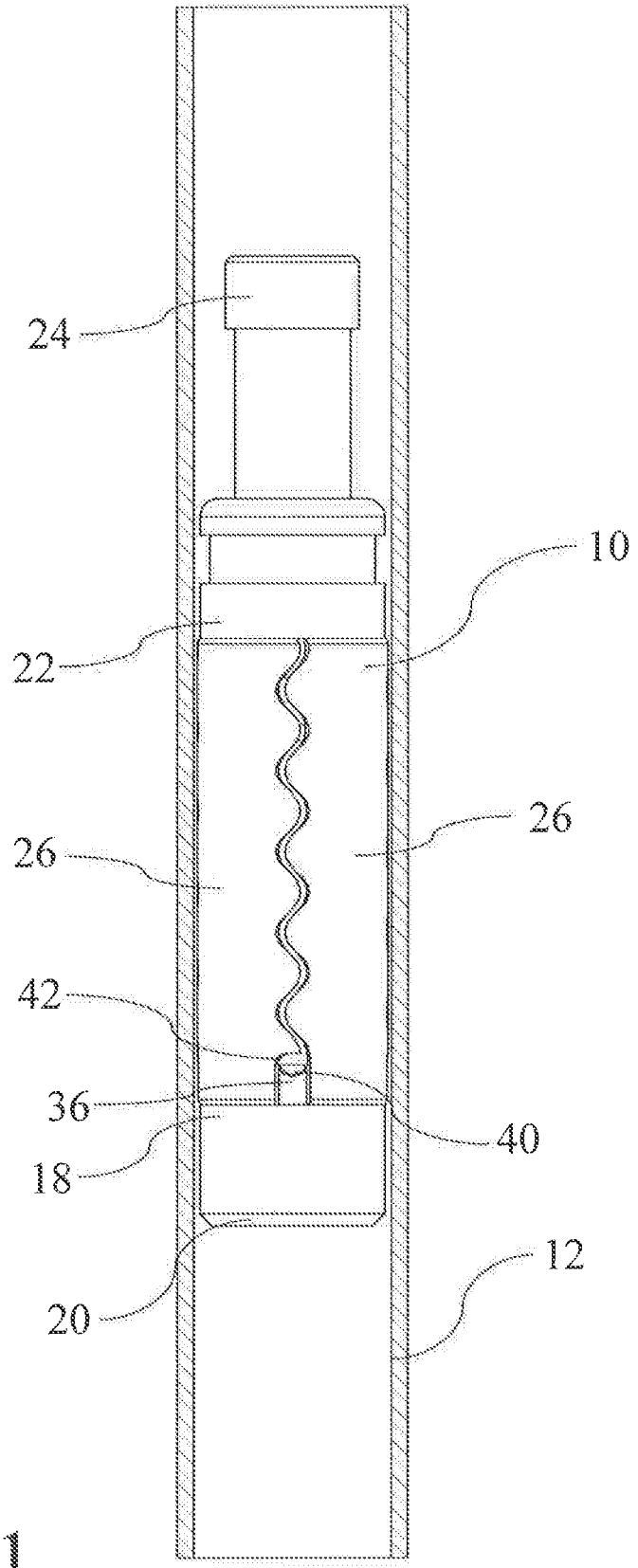
FIG. 1 is a side elevation view of a plunger in a production tubing string.

A plunger, generally identified by reference numeral 10, will now be described with reference to FIG. 1 through 5.

Referring to FIG. 1, plunger 10 is designed to be used in a gas producing well, and in particular, in the production tubing string 12 of the well. While well designs may vary, the production tubing string is intended to refer to any section of the well along which fluids are produced, and along which a plunger is able to travel.

Figure 2:
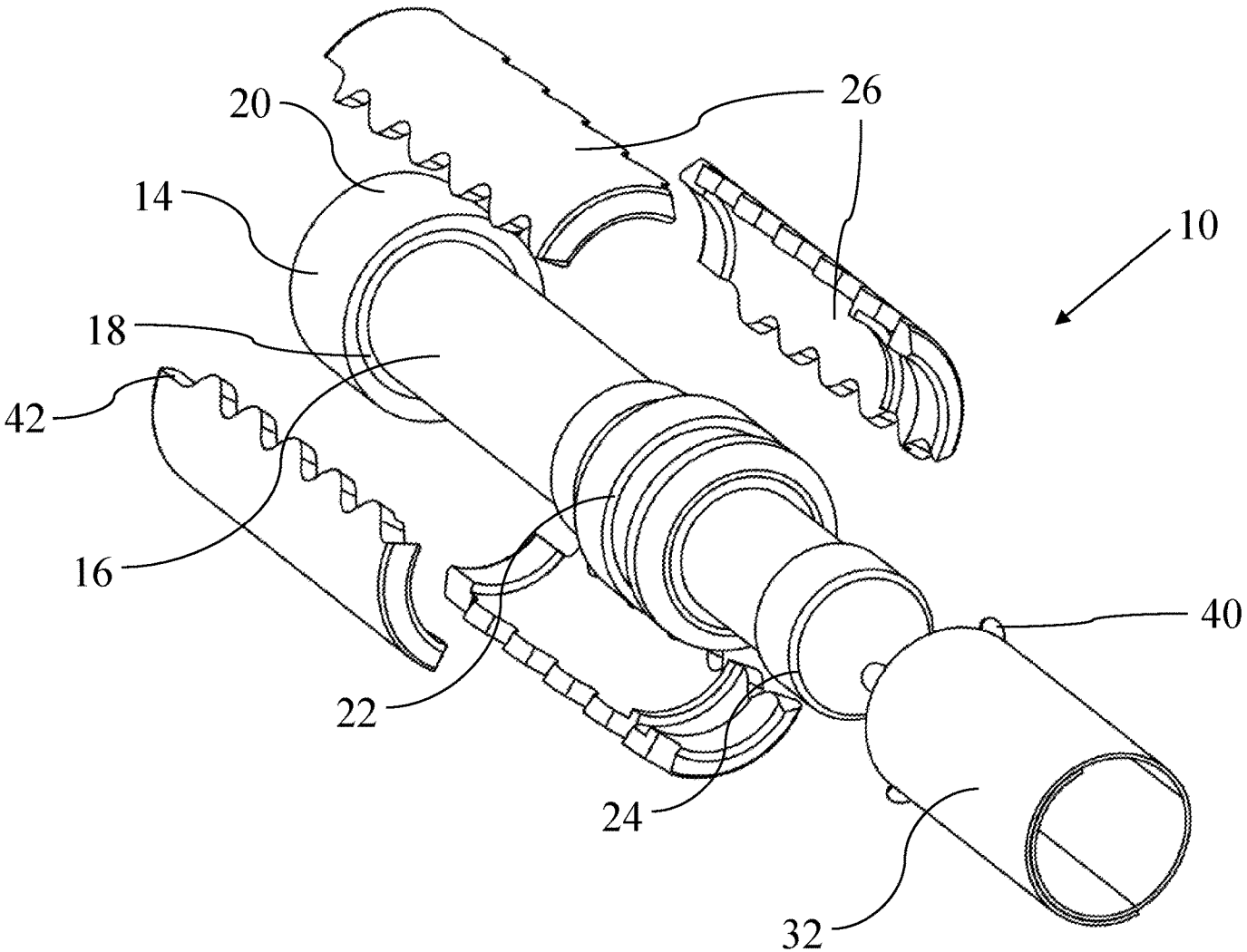
FIG. 2 is an exploded view of a plunger.
Figure 4:
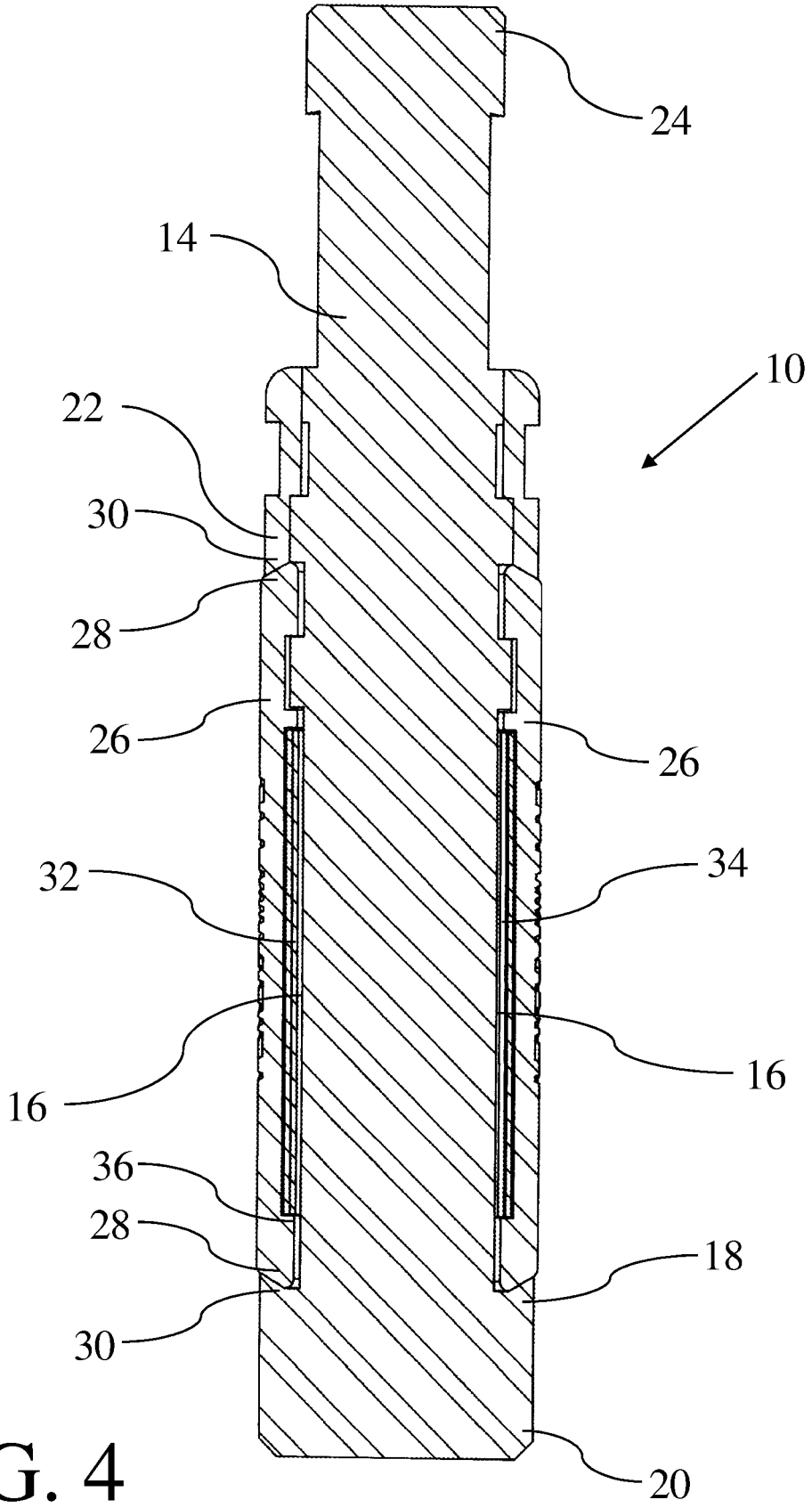
FIG. 4 is a side elevation view in section of the plunger shown in FIG. 2.

Referring to FIG. 2, plunger 10 has a plunger body 14 with a pad receiving profile 16. As shown, pad receiving profile 16 is a recessed section of plunger body 14 that has a first pad retainer 18 positioned toward a downhole end 20 of plunger body 14 and a second pad retainer 22 positioned toward a surface end 24 of plunger body 14. It will be understood that the relative dimensions of each section may vary depending on plunger design from what is depicted. Referring to FIG. 4, in the depicted embodiment, first pad retainer 18 is integrally formed with plunger body 14, while second pad retainer 22 is removable, allowing for the assembly and disassembly of plunger 10.

Plunger body 14 carries a plurality of pads 26 that are retained by retainers 18 and 22. Pads 26 are designed to be wear or seal pads, and are designed to reduce the wear on plunger body 14 as well as provide a seal against the inner surface of production tubing 12 in use. As is known by those skilled in the art, the seal between plunger body 14 and production tubing 12 is generally not an air-tight seal. Instead, a small amount of gas or fluid is permitted to flow around pads 26 to help lubricate and reduce wear on plunger 10 as it travels along production tubing 12. However, it is important that the restriction between pads 26 and tubing string 12 be sufficient to create a pressure differential that allows plunger 10 to lift a certain amount of fluid to surface as it cycles.

Pads 26 are engaged between first and second pad retainers 18 and 22. First and second pad retainers 18 and 22 generally restrict the axial movement of pads 26 relative to plunger body 14, although there may be some tolerance for limited movement as long as plunger 10 is able to operate effectively. First and second pad retainers 18 and 22 are designed to allow a limited amount of radial movement of pads 26 relative to plunger body 14. In the depicted embodiment, referring to FIG. 4, this is accomplished by providing tapered engagement surfaces 28 on pads 26 and corresponding tapered engagement surfaces 30 on retainers 18 and 22 that overlap engagement surfaces 28. Pad retainers 18 and 22 preferably permit sufficient radial movement for pads 26 to come into contact with, and retract from, production tubing string 12.

Figure 3:
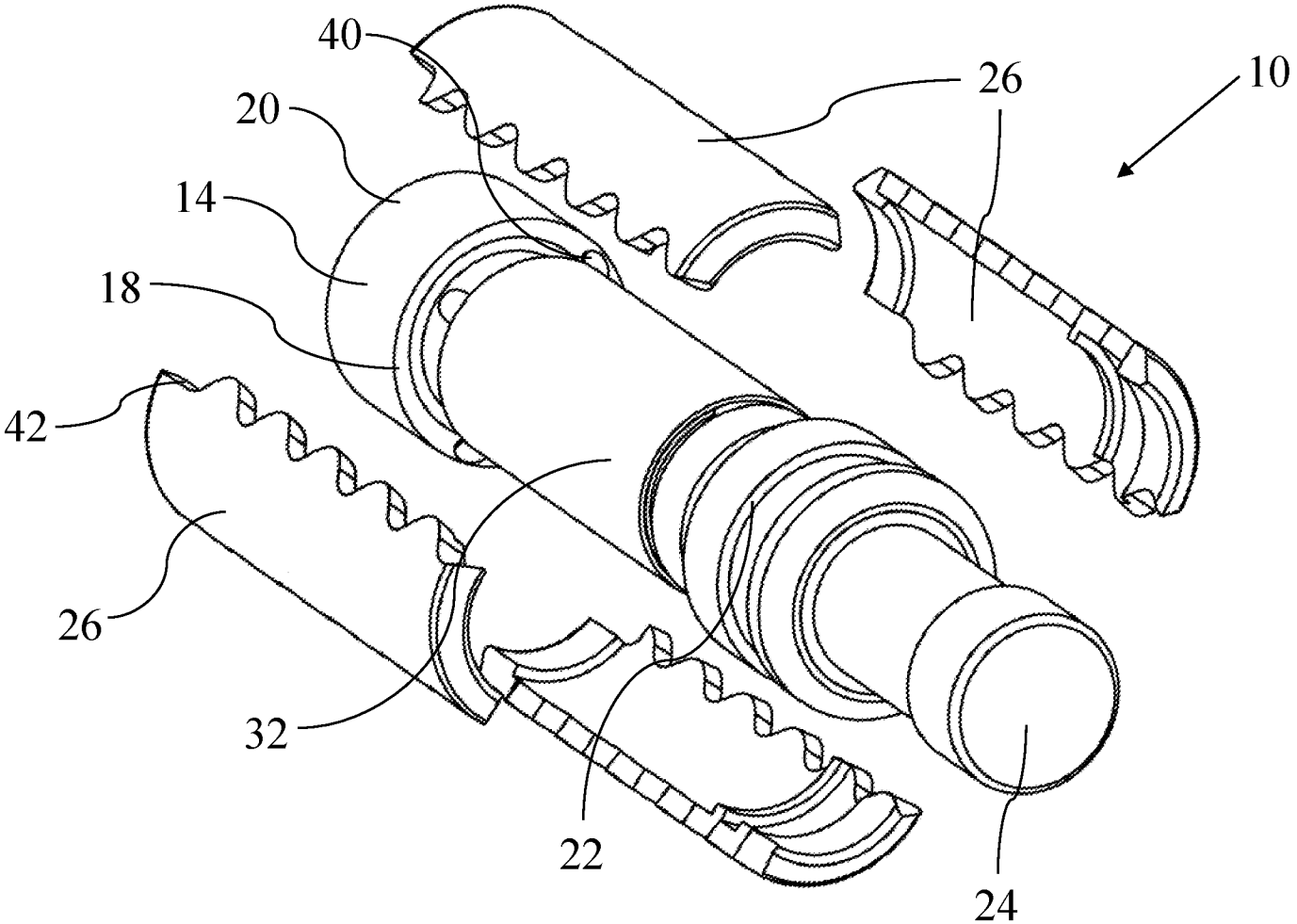
FIG. 3 is an exploded view of a plunger with the spring member installed on the plunger body.

Referring to FIGS. 2 and 3, a spring member 32 is positioned within pad receiving profile 16, between the pads 26 and plunger body 14. As shown, spring member 32 is a sheet of resilient material that is wrapped around plunger body 14 such that the ends overlap at least partially.

Figure 5:
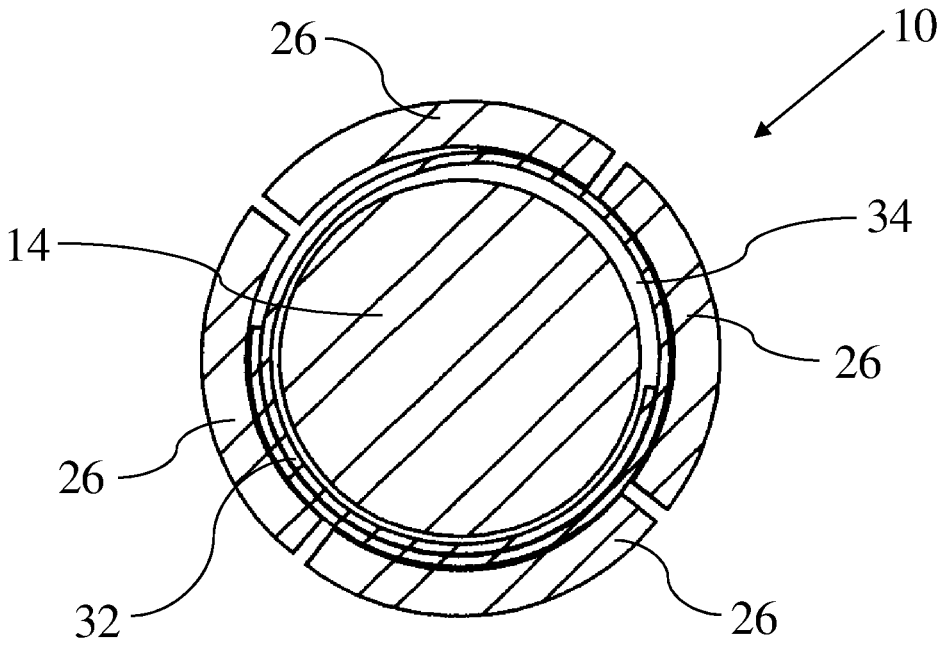
FIG. 5 is a top plan view in section of the plunger shown in FIG. 2.

Referring to FIGS. 4 and 5, spring member 32 is biased such that it applies an outward force to plurality of pads 26 toward production tubing 12. The amount of outward force applied by spring member 32 is preferably weak, and is primarily sufficient to keep pads 26 engaged with production tubing 12, while allowing pads 26 to move inward when an opposing force is applied. In particular, spring member 32 applies a sufficiently weak force that pads 26 move inward a sufficient distance to allow plunger 12 to move downward through production tubing string 12 at the end of a lift cycle. However, when moving upward during the lift cycle, the force applied to pads 26 is augmented as described below.

As can be seen, an annular chamber 34 is defined between spring member 32 and plunger body 12, and by pad retainers 18 and 22. The overlap in spring member 32 creates a fluid chamber 34. There a one or more flow channels 36 that are in fluid communication with annular chamber 34 and the downhole end of plunger body 12. As will be understood, it is unnecessary that fluid chamber 34 be fluid tight. Instead, fluid chamber 34 is designed to create a sufficient restriction that will result in a pressure differential across spring member 32.

Referring to FIG. 1, there is a flow channel 36 corresponding to each pad 26. In the depicted embodiment, referring to FIGS. 2 and 3, flow channels 36 are formed in conjunction with alignment tabs 40 on spring member 32 that engage recessed ports 42 in pads 26 in order to simplify the proper alignment and position of pads 26 and spring member 32. Using this approach, alignment tabs 40 are able to both assist in assembly, and allow chamber 34 to be pressurized. In use, downhole pressure is communicated to the annular chamber 34 to create a pressure differential across spring member 32, such that the outward force applied by spring member 32 to the plurality of pads 26 is increased. It will be understood that the number of flow channels 36 and the exact position of each will depend on the preferences of the user. In particular, flow channels 36 need not be integrated with tabs 40 or recessed ports 42.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A plunger for a gas producing well having a production tubing string, the plunger comprising:

a plunger body having a pad receiving profile defined by a first pad retainer positioned toward a downhole end of the plunger body and a second pad retainer positioned toward a surface end of the plunger body;

a plurality of pads engaged between the first pad retainer and the second pad retainer, the first and second pad retainers permitting limited radial movement of the pads sufficient to contact an inner surface of the production tubing string, and each of the plurality of pads having a top engagement end that engages the second pad retainer and a bottom engagement end that engages the first pad retainer;

a spring member positioned within the pad receiving profile and between the plurality of pads and the plunger body, the spring member comprising a sheet of resilient material having opposed first and second side edges, and top and bottom edges connecting the first side edge and the second side edge, the sheet of resilient material being wrapped around the plunger body such that the first side edge of the resilient material overlaps the second side edge of the resilient material, the top edge of the sheet of resilient material being oriented toward the top engagement end of each of the plurality of pads and the bottom edge of the sheet of the resilient material being oriented toward to the bottom engagement end of each of the plurality of pads, the sheet of resilient material being biased such that the sheet of resilient material applies an outward force to the plurality of pads, the spring member defining an annular chamber between the plurality of pads and the plunger body; and one or more flow channels in fluid communication with the annular chamber and the downhole end of the plunger body, wherein fluid flow through the annular chamber is restricted such that in use, downhole pressure is communicated to the annular chamber to create a pressure differential across the spring member such that the outward force applied by the sheet of resilient material to the plurality of pads is increased.

2. The plunger of claim 1, wherein the sheet of resilient material comprises alignment tabs along a bottom edge, the alignment tabs engaging openings toward the downhole end of the plunger body, the openings being provided in at least one of the plurality of pads and the first pad retainer.

3. The plunger of claim 2, wherein the openings engaged by the alignment tabs comprise the one or more flow channels.

* * * * *